US005125171A

United States Patent [19]

Stewart

[11] Patent Number: 5,125,171

[45] Date of Patent: Jun. 30, 1992

[54] SHOE WITH SPRING BIASED UPPER

[76] Inventor: Douglas J. Stewart, 12888 C Grays Pointe Rd., Fairfax, Va. 22033

[21] Appl. No.: 565,461

[22] Filed: Aug. 10, 1990

[51] Int. Cl.[5] ..... A43B 7/20

[52] U.S. Cl. ..... 36/89; 36/114; 36/58.5

[58] Field of Search ..... 36/114, 89, 90, 58.5, 36/58

[56] References Cited

U.S. PATENT DOCUMENTS

| | | | |
|---|---|---|---|
| 246,984 | 9/1881 | Stillman . | |
| 406,328 | 7/1889 | Yagn . | |
| 519,656 | 5/1894 | Barber | 36/58.5 |
| 522,371 | 7/1894 | Mayer et al. | 36/89 |
| 526,956 | 10/1894 | Wright | 36/58.5 |
| 1,446,230 | 2/1923 | Welter . | |
| 1,510,408 | 6/1922 | Lychou . | |
| 1,610,700 | 12/1926 | Morton | 36/89 |
| 1,692,896 | 11/1928 | Hilgert | 36/89 |
| 2,069,752 | 2/1937 | Dorr | 36/58.5 X |
| 2,302,694 | 11/1942 | Jennings | 36/89 |
| 2,763,071 | 9/1956 | Napier | 36/89 |
| 2,972,822 | 2/1961 | Tanner | 36/89 |
| 3,028,861 | 4/1962 | Shapiro | 36/89 X |
| 3,707,787 | 1/1973 | Hughes | 36/2.5 |
| 3,799,159 | 3/1974 | Scott | 128/80 |
| 3,928,872 | 12/1975 | Johnson | 128/80 |
| 3,970,083 | 7/1976 | Carrigan | 36/89 X |
| 4,130,115 | 12/1978 | Taylor | 128/80 |
| 4,450,832 | 5/1984 | Waddell | 128/80 |
| 4,575,954 | 3/1986 | Bye | 36/58.5 X |
| 4,577,419 | 3/1986 | Chassaing | 36/58.5 X |
| 4,643,176 | 2/1987 | Mason et al. | 128/80 |
| 4,651,726 | 3/1987 | Holland | 128/166 |
| 4,665,905 | 5/1987 | Brown | 128/80 |
| 4,669,457 | 6/1987 | Hallisey | 128/80 |
| 4,671,258 | 6/1987 | Barthlome | 128/26 |
| 4,766,681 | 8/1988 | O'Rourke et al. | 36/89 |
| 4,768,500 | 9/1988 | Mason et al. | 128/80 |
| 4,776,111 | 10/1988 | Crowley | 36/89 |
| 4,936,295 | 6/1990 | Crane | 36/89 X |
| 4,989,350 | 2/1991 | Bunch | 36/89 |

FOREIGN PATENT DOCUMENTS

| | | | |
|---|---|---|---|
| 0854461 | 4/1940 | France | 36/58.5 |
| 0015836 | of 1888 | United Kingdom | 36/89 |
| 0029781 | of 1911 | United Kingdom | 36/58.5 |

*Primary Examiner*—Paul T. Sewell
*Assistant Examiner*—Ted Kavanaugh
*Attorney, Agent, or Firm*—Senniger, Powers, Leavitt & Roedel

[57] ABSTRACT

A shoe comprising a sole, an upper, and at least one spring. The sole includes a portion for supporting the ball of the foot of a user. The upper is secured to the sole and covers the foot of the user when the user is wearing the shoe. The upper includes a portion extending up above the ankle of the user when the user is wearing the shoe. The sole and upper are moveable between a plantarflexion position and a dorsiflexion position. The spring is secured to the upper for biasing the upper in the plantarflexion position. The spring is loaded and energy stored therein as the upper is moved toward the dorsiflexion position whereby the spring urges the upper back toward the plantarflexion position.

21 Claims, 2 Drawing Sheets

SHOE WITH SPRING BIASED UPPER

BACKGROUND OF THE INVENTION

This invention relates generally to shoes, and more particularly to shoes having an upper for supporting the ankle of a user and storing energy when the upper is moved toward the dorsiflexion position.

During athletic endeavors involving jumping and quick movement, such as running, basketball, tennis, etc., a participant's ankles are often subjected to substantial shock The participant must contract certain muscles around the ankle to initiate the jump and then relax those muscles and contract different muscles to counteract the impact of landing The jumping and landing cause the participant to expend much energy, thereby fatiguing the muscles Also, when the participant lands on one foot after jumping, the impact on the ankle may be several times greater than the weight of the participant Such impact often results in ankle injuries.

Most athletic shoes have cushioned soles to absorb some of the shock during impact. The cushioned sole absorbs some of the shock by converting some of the kinetic energy, i.e , the energy of motion, of the user wearing the shoe to heat-energy in the soles This heat-energy is not stored as potential energy to assist the user in jumping. Rather, the heat-energy is dissipated to the environment and, therefore, not useful to the user. A shoe which stores at least some of the kinetic energy as potential energy to assist the use in jumping is needed.

SUMMARY OF THE INVENTION

Among the objects of the present invention may be noted the provision of a shoe for storing potential energy which is convertible to kinetic energy to assist the user in jumping; the provision of such a shoe having spring means therein which urge the shoe toward a plantarflexion position after the shoe is moved to a dorsiflexion position; and the provision of such a shoe which is of relatively simple and lightweight construction.

Generally, a shoe of the present invention comprises a sole, an upper, and a spring. The sole has a portion for supporting the ball of the foot of a user. The upper is secured to the sole and covers the foot of the user when the user is wearing the shoe. The upper has a portion extending up above the ankle of the user when the user is wearing the shoe. The sole and the upper are moveable between a plantarflexion position and a dorsiflexion position. The spring is secured to the upper for biasing the upper in the plantarflexion position. The spring is loaded and energy is stored therein as the upper is moved toward the dorsiflexion position to urge the upper back toward the plantarflexion position.

These and other advantages will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
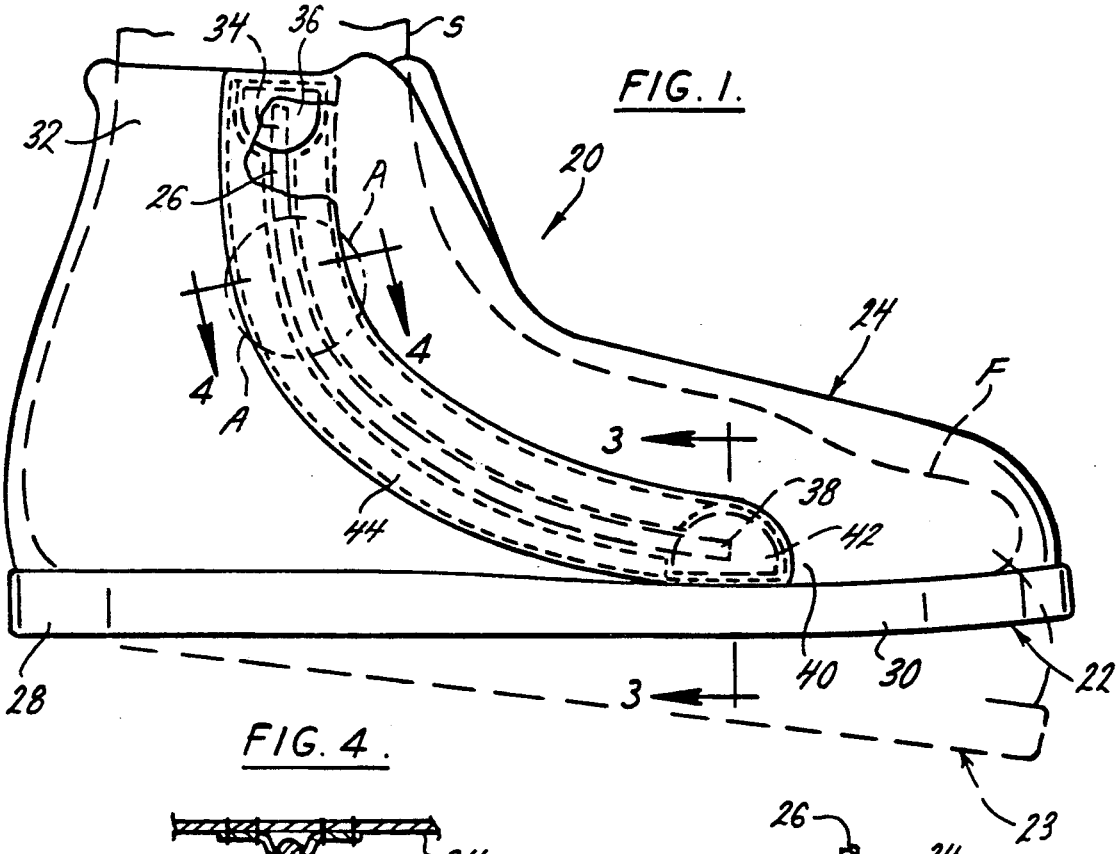
FIG. 1 is a side elevational view of a shoe of this invention.
Figure 2:
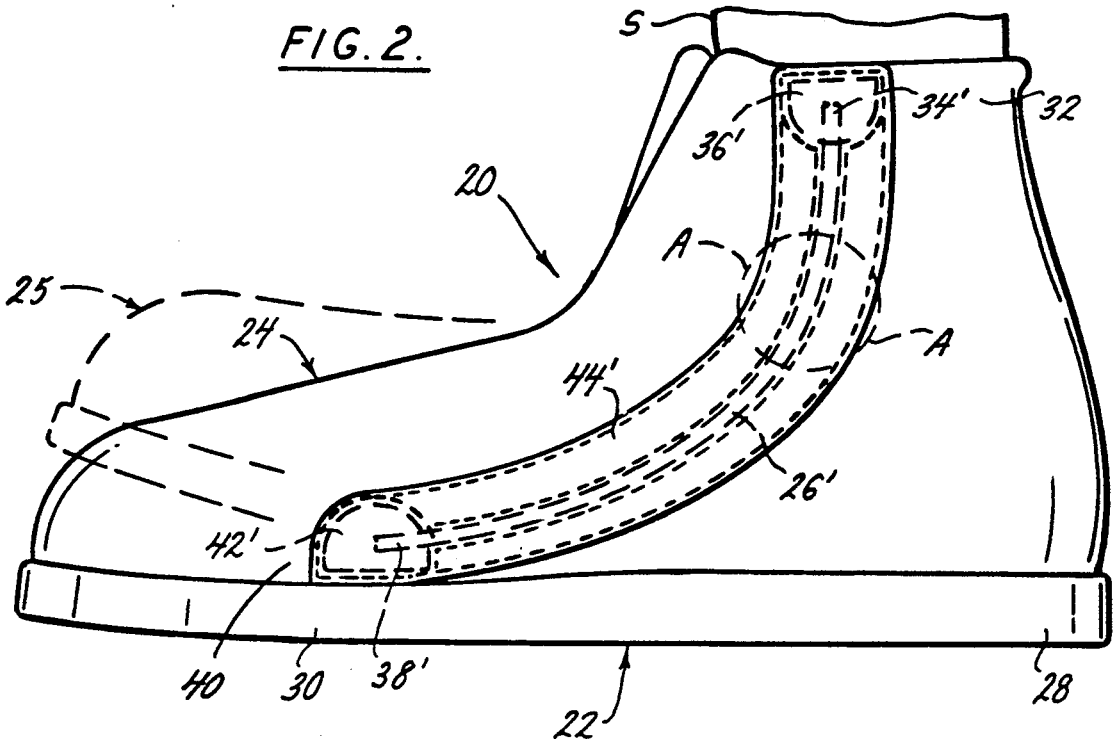
FIG. 2 is an elevational view of the shoe of FIG. 1 showing the side opposite of that shown in FIG. 1.

A shoe constructed according to the principles of this invention is indicated generally as 20 in FIGS. 1 and 2. The shoe 20 includes a sole 22, an upper 24, and first and second spring members 26 and 26'. The sole 22 includes a rearward portion 28 for supporting the heel of a user's foot F and a forward portion 30 for supporting the ball of the user's foot. The upper 24 is secured to the sole 22, preferably by stitching, adhesives, or by some other manner common in the shoe making industry. The upper 24 covers the foot of the user when the user is wearing the shoe 20. The upper 24 includes a top portion 32 extending up above the ankle A of the user when the user is wearing the shoe 20. The sole 22 and upper 24 are moveable between a plantarflexion position, i.e., a position in which the shins and sole of the user form an obtuse angle with respect to each other (designated, generally, in phantom at 23 in FIG. 1), and a dorsiflexion position, i.e., a position in which the shin and sole of the user form an acute angle with respect to each other (designated, generally, in phantom at 25 in FIG. 2). The spring members 26 and 26' are positioned outside the outside surface of the upper 24 and bias the upper 24 in the plantarflexion position. As the upper 24 is moved toward the dorsiflexion position the spring members 26 and 26' are loaded (flexed) and energy is stored in the spring members 26 and 26'. Thus, the spring members 26 and 26' urge the upper 24 back toward the plantarflexion position.

The spring members 26 and 26' are substantially similar and adjacent opposite sides of the upper 24. The first spring member 26 is shown in detail in FIG. 1. The second spring member 26' is shown in FIG. 2. The reference numbers indicating the parts and components of the spring members are the same. However, each reference number for the second spring member 26' is followed by a prime (') symbol.

The first spring member 26 comprises a first bowed resilient rod, also designated as 26. The rod 26 has a first end margin 34 anchored to the top portion 32 of the upper 24 by a first upper anchor 36 and a second end margin 38 anchored to a side portion 40 of the upper 24 by a first lower anchor 42. The second spring member 26' comprises a second bowed resilient rod, also designated as 26'. The rod 26' has a first end margin 34' anchored to the top portion 32 of the upper 24 by a second upper anchor 36' and a second end margin 38' anchored to a side portion 40 of the upper 24 by a second lower anchor 42'. The rods 26, 26 may be made of spring steel, fiber glass, graphite, or some other suitable resilient material. The anchors 36, 36', 42, and 42' are fixed to the rods 26, 26', preferably by an adhesive cement, and are, preferably, made of a tough plastic, such as that manufactured by E. I. du Pont de Nemours under the trademark Hytrel, and are secured to the upper 24 by stitches, rivets, or adhesive. The side portions 40 are adjacent the forward portion 30 of the sole 22. When the user is wearing the shoe 20, the user's ankle A is located generally between the rods 26, 26' and the first end margins 34, 34' extend up above the ankle A and are in generally parallel relation to the shin of the user and remain generally fixed with respect to the shin. Likewise, the second end margins 38, 38' extend down below the ankle and are in generally parallel relation to the foot of the user and remain generally fixed with respect to the ball of the foot. As a result, the rods 26, 26' generally intersect an axis a of the ankle. In general, the outer ankle bone and inner ankle bone are not the same height with respect to the sole 22 so that positioning of the rods 26, 26' on either side of the upper 24 need not be symmetrical.

Figure 4:
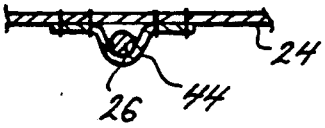
FIG. 4 is a section on line 4—4 of FIG. 1 showing the rod positioned outside the outside surface of the upper and within a sleeve.
Figure 3:
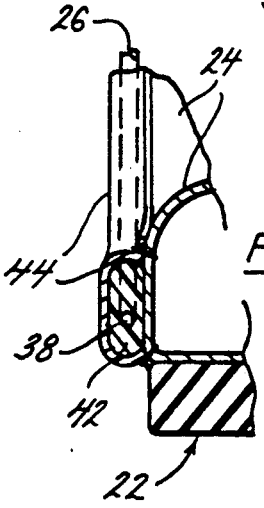
FIG. 3 is a section on line 3—3 of FIG. 1 showing one end of the resilient rod anchored to the shoe upper.

As shown in greater detail in FIGS. 3 and 4, a first sleeve 44 is secured, preferably by stitching, to the upper 24 and envelops spring member 26 and the anchors 36 and 42. A second sleeve 44' is secured to the upper 24 and envelops spring member 26' and the anchors 36' and 42'. The spring members 26, 26' are fixed to the upper 24 only at their respective end margins and, therefore, are free to flex within the sleeves 44, 44'. The sleeves 44, 44' may be made of leather, rubber, or other suitable material.

In operation, the spring members 26, 26' bias the shoe 20 in the plantarflexion position. As the user prepares to jump, he bends his knees and ankles so that his feet and shoes are moved to a dorsiflexion position, thereby further loading the spring members 26 and 26' and storing energy. As the user jumps, the potential energy in the spring members 26 and 26' is converted into kinetic energy to assist the user in jumping. When the user lands toes first, the toes contact the ground and then the ankle and shoe 20 move from a plantarflexion position toward a dorsiflexion position. Since kinetic energy is converted into potential energy in the spring members 26 and 26' when the shoe 20 is moved toward a dorsiflexion position, the shoe 20 absorbs some of the energy of the landing and, thereby, reduces some of the shock to the user's joints.

Figure 5:
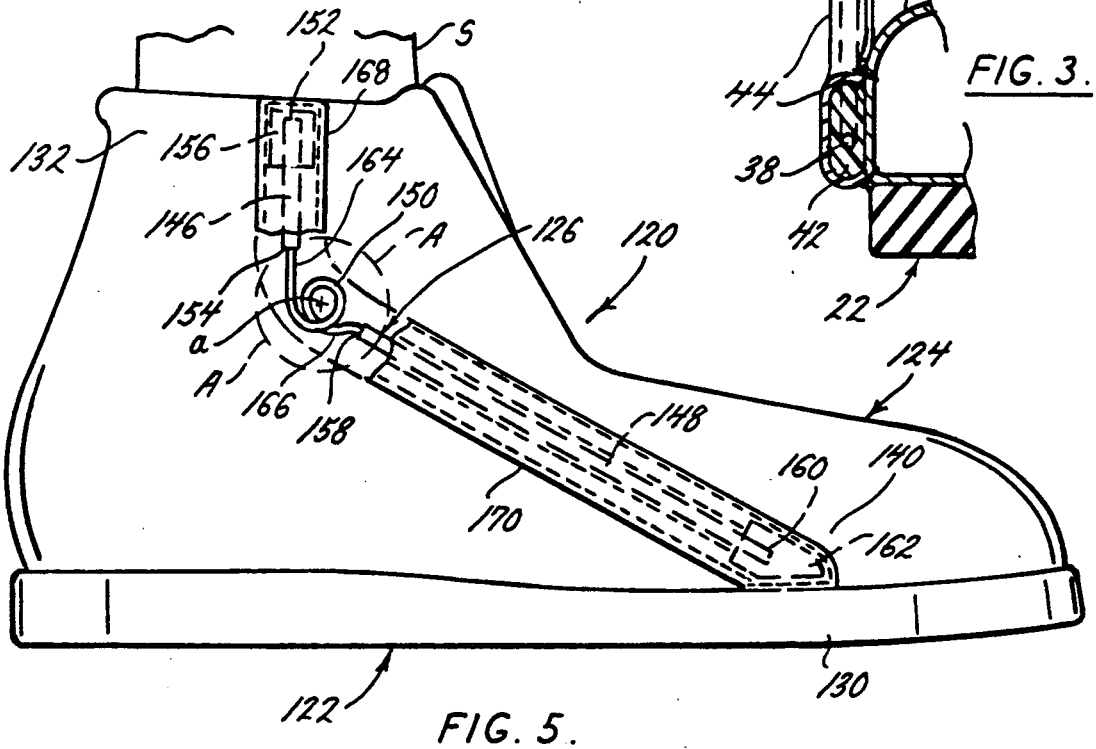
FIG. 5 is a side elevational view of another embodiment of a shoe of this invention in which the spring element includes a spiral spring.
Figure 6:
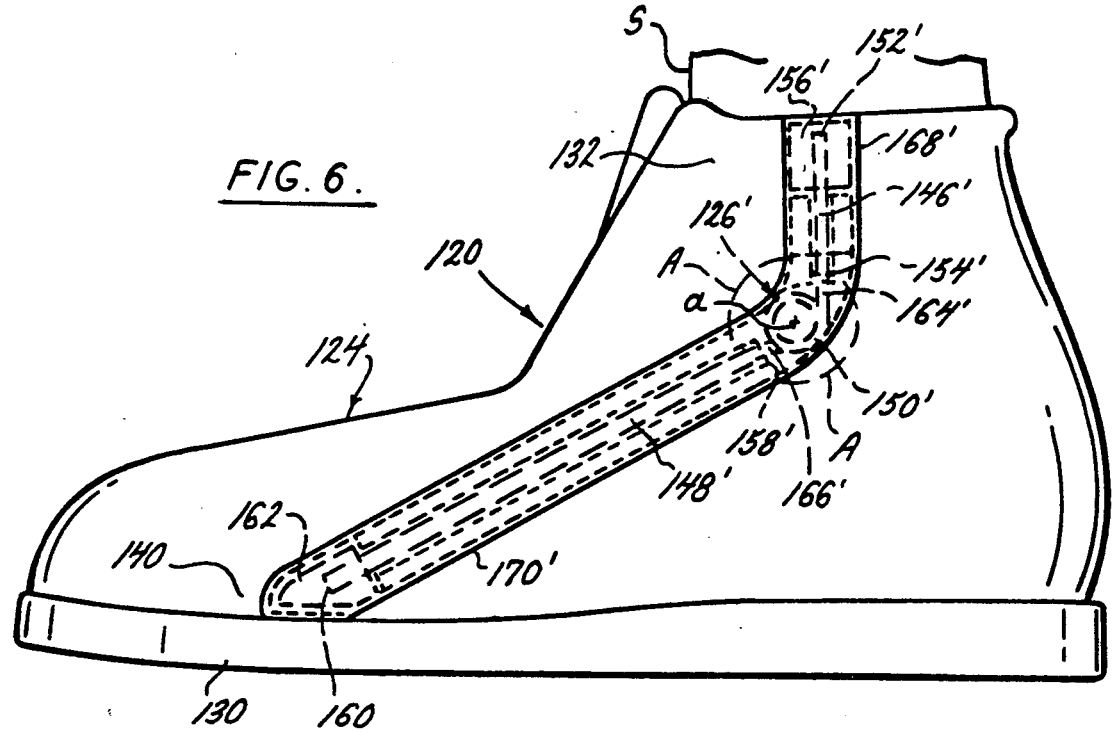
FIG. 6 is an elevational view of the shoe of FIG. 5 showing the side opposite of that shown in FIG. 5.

Another embodiment of a shoe constructed according to the principles of this invention is designated generally as 120 in FIGS. 5 and 6. The shoe 120 includes a sole 122, an upper 124, a first spring member 126, and a second spring member 126'. The sole 122 includes a forward portion 130 for supporting the ball of the user's foot. The upper 124 is secured to the sole 122 and covers the foot of the user when the user is wearing the shoe 120. The upper 124 includes a top portion 132 extending up above the ankle of the user and a forward side portion 140 adjacent the forward portion 130 of the sole 122.

As shown in FIG. 5, the first spring member 126 is positioned outside the outside surface of the upper 124 and comprises a first upper rod 146, a first lower rod 148, and a first spiral spring 150 adjacent ankle A. The first upper rod 146 is adjacent one side of the upper 124 and has a top end 152 and a bottom end 154. The top end 152 is anchored to the top portion 132 by an anchor 156. The lower rod 148 is adjacent the same side of the upper 124 as the upper rod 146 and has a top end 158 and a bottom end 160. The bottom end 160 extends down below the ankle when the user is wearing the shoe and is anchored to the forward side portion 140 by an anchor 162. The spiral spring 150 has a first end 164 connected to the bottom end 154 of the first upper rod 146 and a second end 166 connected to the top end 158 of the first lower rod 148.

As shown in FIG. 6, the second spring member 126' is positioned outside the outside surface of the upper 124 and on the side opposite that of the first spring member 126. The second spring member 126' comprises a second upper rod 146', a second lower rod 148', and a second spiral spring 150' adjacent ankle A. The second upper rod 146' is adjacent one side of the upper 124 and has a top end 152' and a bottom end 154'. The top end 152' is anchored to the top portion 132 by an anchor 156'. The lower rod 148' is adjacent the same side of the upper 124 as the upper rod 146' and has a top end 158' and a bottom end 160'. The bottom end 160' extends down below the ankle when the user is wearing the shoe and is anchored to the forward side portion 140 by an anchor 162'. The second spiral spring 150' has a first end 164' connected to the bottom end 154' of the second upper rod 146' and a second end 166' connected to the top end 158' of the second lower rod 148'. Although each spring member has been described as having three separate parts connected together, i.e., an upper rod, a spring, and a lower rod, it is to be understood that the parts could be integrally formed without departing from the principles of this invention.

The first and second upper rods 146, 146' are positioned within first and second upper sleeves 168, 168', respectively, secured to the upper 124. The first and second lower rods 148, 148' are positioned within first and second lower sleeves 170, 170', respectively, secured to the upper 124. The sleeves may be made of leather, rubber, or other suitable material, and are preferably secured to the upper by stitching. As shown in FIGS. 5 and 6, when the user is wearing the shoe 120, the upper rods 146, 146' are in generally parallel relation to the shin of the user and the lower rods 148, 148' are in generally parallel relation to the foot of the user. The spring members 126, 126' are fixed to the upper 124 only at their respective ends and, therefore, are free to flex within the sleeves.

In operation, the spiral springs 150, 150' of the spring members 126, 126' bias the shoe 120 in the plantarflexion position. As the user prepares to jump, he bends his knees and ankles so that his feet and shoes are moved to a dorsiflexion position, thereby loading the springs 150, 150'. As the user jumps, the springs 150, 150' unload to assist the user in jumping. When, after jumping, the user lands toes first, the toes contact the ground and then the ankle and shoe 120 move from a plantarflexion position toward a dorsiflexion position. Since the springs are biased to the plantarflexion position, the shoe 120 absorbs energy when the shoe 120 is moved toward a dorsiflexion position. Thus, during landing, the shoe 120 reduces some of the shock to the user's joints.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limited sense.

What is claimed is:

1. A shoe moveable between a plantarflexion position and a dorsiflexion position comprising a first portion for surrounding a lower portion of a user's shin, a second portion for surrounding the user's foot, and first and second springs on opposite sides of the shoe and between the first and second portions, said springs urging the shoe toward the plantarflexion position when the shoe is moved to any position between the plantarflexion position and the dorsiflexion position.

2. A shoe as set forth in claim 1 wherein said first and second springs bias the shoe in the plantarflexion position.

3. A shoe as set forth in claim 1 wherein said first and second springs comprise first and second curved resilient rods, respectively, each having an upper end anchored to the first portion and a lower end anchored to the second portion, the user's ankle being located generally between the first and second rods and said upper ends being generally up above the user's ankle and said lower ends being generally down below the user's ankle when the user is wearing the shoe.

4. A shoe as set forth in claim 1 wherein the first spring comprises a first spiral spring, a first upper rod having a top end anchored to said first portion and a bottom end connected to the first spiral spring, and a first lower rod having a top end connected to the first spiral spring and a bottom end anchored to the second portion, and wherein the second spring comprises a second spiral spring, a second upper rod having a top end anchored to said first portion and a bottom end connected to the second spiral spring, and a second lower rod having a top end connected to the second spiral spring and a bottom end anchored to the second portion, the user's ankle being located generally between the first and second spiral springs when the user is wearing the shoe.

5. A shoe as set forth in claim 1 wherein said first and second springs comprise first and second resilient rods, respectively, each including a generally straight upper segment having an upper end anchored to the first portion, a generally straight lower segment having a lower end anchored to the second portion, and a bend between the upper and lower segment, said upper segments being in generally parallel relation to the shin of the user and said lower segments being in generally parallel relation to the foot of the user when the user is wearing the shoe, the ankle of the user being located generally between the first and second rods and said upper ends being generally up above the user's ankle and said lower ends being generally down below the user's ankle when the user is wearing the shoe.

6. A shoe comprising:

a sole having a portion thereof for supporting the ball of the foot of a user;

an upper secured to the sole for covering the foot of the user when the user is wearing the shoe, said upper having a portion extending up above the ankle of the user when the user is wearing the shoe, said sole and said upper being moveable between a plantarflexion position and a dorsiflexion position; and spring means secured to the upper for biasing the upper in the plantarflexion position, said spring means being loaded and energy stored therein as the upper is moved from the plantarflexion position toward the dorsiflexion position whereby said spring means urges the upper from any position between the dorsiflexion position and plantarflexion position toward the plantarflexion position.

7. A shoe as set forth in claim 1 wherein said spring means comprises a first bowed resilient rod adjacent one side of the upper, said first rod having a first end anchored to the portion extending up above the ankle and a second end extending down below the ankle when the user is wearing the shoe and anchored to at least one of the sole and upper.

8. A shoe as set forth in claim 7 wherein the rod intersects an axis of the ankle and wherein said second end is anchored adjacent the portion of the sole for supporting the ball of the foot.

9. A shoe as set forth in claim 2 wherein said spring means further comprises a second bowed resilient rod adjacent the other side of the upper, said second rod having a first end anchored to the portion extending up above the ankle and a second end extending down below the ankle when the user is wearing the shoe and anchored to at least one of the sole and upper and adjacent the portion of the sole for supporting the ball of the foot, the ankle located generally between the first and second rods.

10. A shoe as set forth in claim 9 wherein said rods are positioned outside the outside surface of the upper.

11. A shoe as set forth in claim 9 wherein the second end of the first rod is anchored to the upper and the second end of the second rod is anchored to the upper.

12. A shoe as set forth in claim 9 wherein said first and second rods are positioned within first and second sleeves, respectively, secured to the upper.

13. A shoe as set forth in claim 12 wherein said sleeves are secured to the outside surface of said upper.

14. A shoe as set forth in claim 9 wherein said first and second rods each have a first end margin generally in parallel relation to the shin of the user when the user is wearing the shoe and a second end margin generally in parallel relation to the foot of the user when the user is wearing the shoe.

15. A shoe as set forth in claim 1 wherein said spring means comprises:

a first upper rod adjacent one side of the upper and having a top end and a bottom end, the top end of said first upper rod being anchored adjacent the portion extending up above the ankle;

a first lower rod adjacent said one side of the upper and having a top end and a bottom end, the bottom end of said lower rod extending down below the ankle when the user is wearing the shoe and being anchored to at least one of the sole and upper; and a first spring connecting the bottom end of the first upper rod to the top end of the first lower rod.

16. A shoe as set forth in claim 15 wherein said first spring comprises a spiral spring adjacent the ankle and having a first end connected to the bottom end of the first upper rod and having a second end connected to the top end of the first lower rod.

17. A shoe as set forth in claim 15 wherein said spring means further comprises:

a second upper rod adjacent the other side of the upper and having a top end and a bottom end, the top end of said second upper rod being anchored adjacent the portion extending up above the ankle;

a second lower rod adjacent said other side of the upper and having a top end and a bottom end, the bottom end of said second lower rod extending down below the ankle when the user is wearing the shoe and being anchored to at least one of the sole and upper; and a second spring connecting the bottom end of the second upper rod to the top end of the second lower rod.

18. A shoe as set forth in claim 17 wherein said rods and springs are positioned outside the outside surface of the upper.

19. A shoe as set forth in claim 18 wherein the bottom ends of the lower rods are anchored to the upper.

20. A shoe as set forth in claim 19 wherein said first and second upper rods are positioned within first and second upper sleeves, respectively, secured to the upper, and said first and second lower rods are positioned within first and second lower sleeves, respectively, secured to the upper.

21. A shoe as set forth in claim 17 wherein said first and second upper rods are in generally parallel relation to the shin of the user when the user is wearing the shoe and said first and second lower rods are in generally parallel relation to the foot of the user when the user is wearing the shoe.

* * * * *

UNITED STATES PATENT AND TRADEMARK OFFICE

CERTIFICATE OF CORRECTION

PATENT NO. : 5,125,171

DATED : June 30, 1992

INVENTOR(S) : Douglas J. Stewart

It is certified that error appears in the above-identified patent and that said Letters Patent is hereby corrected as shown below:

Column 5, claim 7, line 66: "1" should read --6--.

Column 6, claim 9, line 9: "2" should read --7 .

Column 6, claim 15, line 36: "1" should read --6--.

Signed and Sealed this

Twenty-fourth Day of August, 1993

Bruce Lehman

*Attest:*

BRUCE LEHMAN

*Attesting Officer*

*Commissioner of Patents and Trademarks*